US005187964A

United States Patent [19]

Levy

[11] Patent Number: 5,187,964

[45] Date of Patent: Feb. 23, 1993

[54] VARIABLE WIDTH ROLLER FORMING MACHINE

[75] Inventor: Roger Levy, Bloomfield Hills, Mich.

[73] Assignee: Tishken Products Co., Detroit, Mich.

[21] Appl. No.: 777,686

[22] Filed: Oct. 15, 1991

[51] Int. Cl.[5] ..... B21D 5/08

[52] U.S. Cl. ..... 72/181; 72/247

[58] Field of Search ..... 72/181, 180, 226, 247, 72/249

[56] References Cited

U.S. PATENT DOCUMENTS

| | | | |
|---|---|---|---|
| 125,691 | 4/1872 | Price | 72/181 |
| 1,673,787 | 6/1928 | Frahm | 72/181 |
| 4,831,857 | 5/1989 | Levy | 72/181 |
| 5,060,498 | 10/1991 | Seto | 72/247 |

FOREIGN PATENT DOCUMENTS

| | | | |
|---|---|---|---|
| 1777039 | 10/1971 | Fed. Rep. of Germany | 72/181 |
| 212812 | 12/1983 | Japan | 72/181 |
| 17310 | 1/1986 | Japan | 72/247 |
| 156007 | 7/1987 | Japan | 72/247 |
| 317607 | 12/1989 | Japan | 72/247 |
| 584978 | 1/1947 | United Kingdom | 72/181 |

*Primary Examiner*—Daniel C. Crane
*Attorney, Agent, or Firm*—Dykema Gossett

[57] ABSTRACT

An improved roll forming machine has a machine base, a mounting plate affixed to said machine base, a fixed base plate mounted to said mounting plate, and a movable base plate laterally movable with respect to said fixed base plate. A main block is mounted to said fixed base plate in which are journalled a first plurality of pairs of roller receiving shafts. Journalled to upright stands affixed to the movable base plate are a second or equal plurality of axially aligned roller receiving sleeves which fit over reduced diameter portions of the shafts and are rotated thereby. Movement of the movable base plate causes the sleeves to slide laterally on the shafts and change the width of the workpiece produced by the roll forming machine.

9 Claims, 7 Drawing Sheets

VARIABLE WIDTH ROLLER FORMING MACHINE

BACKGROUND OF THE INVENTION

1. Field of the Invention

The present invention relates to roller forming machinery of the type in which a flat strip of metal to be formed is passed through a series of tandem aligned rolls that progressively form the final shape. More particularly, the invention relates to a variable width roll forming machine wherein a plurality of roller accepting shafts are journaled to a main block mounted to a fixed base plate, and an equal plurality of axially aligned roller accepting sleeves are journaled for rotation in vertical stands mounted to a movable base plate. As the movable base plate is moved laterally, the sleeves move back and forth over a reduced diameter portion of the roller accepting shafts to vary the width of the roll forming machine. Although this arrangement is advantageous for all types of roll forming production, it is particularly advantageous in a panel roll forming machine where panels of the same type of cross-section can be formed in many different widths simply by moving the base plate of the roll forming machine thus saving costly down time which was necessary with prior art machines.

2. Description of the Prior Art

The roller forming process basically involves taking a coiled flat strip of metal and passing the same through a series of tandem aligned rolls that progressively cold form the final shape. Pre-notching, piercing, embossing, coiling and flying cutoff machines can be incorporated as automatic operations in the roll forming process. The forming rollers of prior art roll forming machines are generally arranged in mating pairs, with the two rollers of each pair configured to produce a predetermined lateral deformation of an elongated metal sheet passed lengthwise between them. Normally, such a machine comprises several pairs of forming rollers, and each pair of rollers takes what is known as a "pass" at the strip of material. The rollers or passes are located at spaced intervals along the path traversed by the workpiece. They cooperate to impart a progressive deformation or bend to the workpiece as it works through successive forming roller pairs along that path. A wide variety of roll formed products in fields such as the automotive, building, furniture, appliance and toy field have made roller forming a very popular and almost essential process in the manufacturing industry today. Although an almost endless variety of profiles can be imparted to workpieces with roller forming machinery, the production of each different profile, and even different widths of the same profile has required, until the time of the present invention, the use of a different set of forming rollers.

Each profile usually requires the presence of several rollers on each of the roller receiving shafts. The two roller shafts for each roller pair usually have their opposite ends journaled in bearings that are either mounted in a main block, or on support stands at each side of the machine. Gears are secured to the roller shafts near their ends adjacent to the main block for drivingly connecting the shafts with a drive means. Thus, the interchange of forming rollers for conversion to production of a different type of workpiece has involved, in prior art machines, the removal and installation of all of the support stands along the side of the machine remote from the main block. This has involved hours of time for each tooling change, with the roller forming machine being out of production during each changeover.

This had led those skilled in the roller forming art to provide a large variety of different solutions to the problems of roll forming machine changeover. Two popular attempts at solving these problems have been the "raft plate" type of roll forming machine and the "turret type" roll forming machine.

U.S. Pat. No. 4,557,129 issued Dec. 10, 1985 to applicant's assignee is an example of the turret type machine. In this type of roll forming machine, a rotatable turret mount assembly is provided to support a plurality of radially extending preset sets of form roll tooling, with each set being adapted for a different form of final product. The turret mount assembly is adapted for selected limited rotation upon a longitudinal axis to rapidly place any one of the plurality of preset sets of tooling in its operational position. Gear means interconnect a transmission means and the forming rolls for rotation thereof in unison. This type of machine is very advantageous in certain production situations but does require the supplying of four sets of roll forming machinery and its related expense.

Another type of turret roller forming machine is shown in U.S. Pat. No. 4,724,695 issued Feb. 16, 1988 to Herbert M. Stoehr. In this case, paired roller carrying shafts of a roller forming machine are arranged in side by side sets on a table normally supported on a fixed base but elevatable for 180° rotation. Thus, either one of the two sets can be in operation coupled to drive heads on the base along one side while the other set is idle. Axially movable clutch members on the drive edge provide for their quick connection to and disconnection from the outboard sets of roller shafts of the set in the operative position. However, this machine also requires a provision of extra sets of roller forming machinery.

An example of the most recent attempt of which applicant is aware to solve this problem is U.S. Pat. No. 4,831,851 issued May 23, 1989 to applicant's assignee. Applicant is a co-inventor of such roll forming machine. The specification of this patent is specifically incorporated herein by reference. Some of the transmission and drive features of such machine are used in the present invention. In this type of roll forming machine, a rafted roll form assembly, including a raft plate and a plurality of vertically aligned, power rotated, longitudinally spaced pairs of complimental rolls are arranged in a set to successively and operatively receive and feed there between elongated strips of stock. A gear train including a plurality of gears and a drive gear interconnect the sets of rolls. In order to change the rafted roll form assembly, including the raft plate and the set of complimental rolls carried by the raft plate to another roll form assembly for making another metal part, a quick disconnect structure is provided which includes a drive clutch on the drive gear of the gear train of the raft assembly. This construction enables one set of forming rollers, or one raft, to be immediately removed from the roll forming machine and replaced by a second raft when it is necessary to change the roll forming operation. This construction solved many problems in the prior art, but did not solve the problem of how to quickly change from making panels of one transverse configuration in several different widths, as there was no easy way to vary the width of the forming rollers on the roll forming machine. This is particularly a problem in making wide, flat, panels having forming substantially only at the edges thereof.

SUMMARY OF THE PRESENT INVENTION

In order to provide an improved panel type roll forming machine capable of forming panels having similar transverse cross sections, but being of variable width, quickly and easily, an improved roll forming machine is provided which has a machine base, a mounting plate affixed to said machine base, a fixed base plate mounted to said mounting plate, and a movable base plate laterally movable with respect to said fixed base plate. A main block is mounted to said fixed base plate in which are journaled a first plurality of pairs of roller receiving shafts. Journaled to upright stands affixed to the movable base plate are a second, or equal, plurality of axially aligned, roller receiving sleeves which fit over reduced portions of the shafts and are rotated thereby. Movement of the movable base plate changes the width of the panel which can be produced, especially in configurations which only have forming taking place near the lateral edges thereof, with wide flat sections in the middle. The machine can be changed to produce panels of different widths in a matter of minutes by operation of a movable base plate drive means or cone drive.

In one embodiment of the present invention, a roller forming machine having a machine base with a mounting plate provided thereon is shown. A fixed base plate is mounted to said mounting plate, and a movable base plate laterally movable with respect to said fixed base plate is provided.

In another embodiment of the present invention, a fixed base plate and a movable base plate are mounted to a machine base. A plurality of vertically aligned, power rotated, longitudinally spaced, pairs of adjustable complimentary roller receiving shaft means are arranged in a plurality of longitudinal sets to successively and operatively receive and feed therebetween elongated strips of stock are journaled for rotation and drive to a main block affixed to said fixed base plate.

In a further embodiment of the invention, a roll forming machine having a movable base plate and a fixed base plate mounted upon a mounting plate affixed to a machine base is provided. A plurality of vertically aligned, power rotated, longitudinally spaced pairs of complimental roller receiving shafts having a sleeve receiving portion and a roller receiving portion are arranged in a plurality of longitudinal sets and journaled for driving rotation to a main block mounted to said fixed mounting plate. An equal plurality of vertically aligned, longitudinally spaced pairs of complimental roller receiving sleeves, axially aligned with their respective sleeve receiving portions of said roller receiving shafts are arranged in a plurality of longitudinal sets to be rotated by said roller receiving shafts. The roller receiving sleeves are journaled for rotation in a plurality of spaced upright stands mounted to said movable support plate.

Thus, an object of the present invention is to provide a roller forming machine wherein the width of the path open to the blank of stock to be formed is easily variable without any disassembly of the machine.

A further object of the present invention is to provide an improved roller forming machine wherein the forming rollers are mountable on a two-part roller shaft means consisting of a roller receiving shaft having a reduced or sleeve receiving portion, and a roller receiving sleeve slidably movable on said sleeve receiving portion and keyed thereto for rotation by said roller receiving shafts.

A still further object of the present invention is to provide an improved roll forming machine comprising vertically aligned, power rotated, longitudinally spaced pairs of complimental roller receiving shafts journaled for rotation and power to a main block affixed to a fixed mounting plate. A second equal plurality of vertically aligned, longitudinally spaced pairs of complimental roller receiving sleeves, driven by said roller receiving shafts, are journaled for rotation in a plurality of longitudinally spaced upright stands affixed to said movable mounting plate.

A still further object of the present invention is to provide an improved panel type roll forming machine wherein the width of the path available is easily adjusted, and the height of the upper rollers can be easily adjusted.

Further objects and advantages of this invention will be apparent from the following description and appended claims, reference being had to the accompanying drawings forming a part of this specification, wherein like reference characters designate corresponding parts in the several views.

Figure 1:
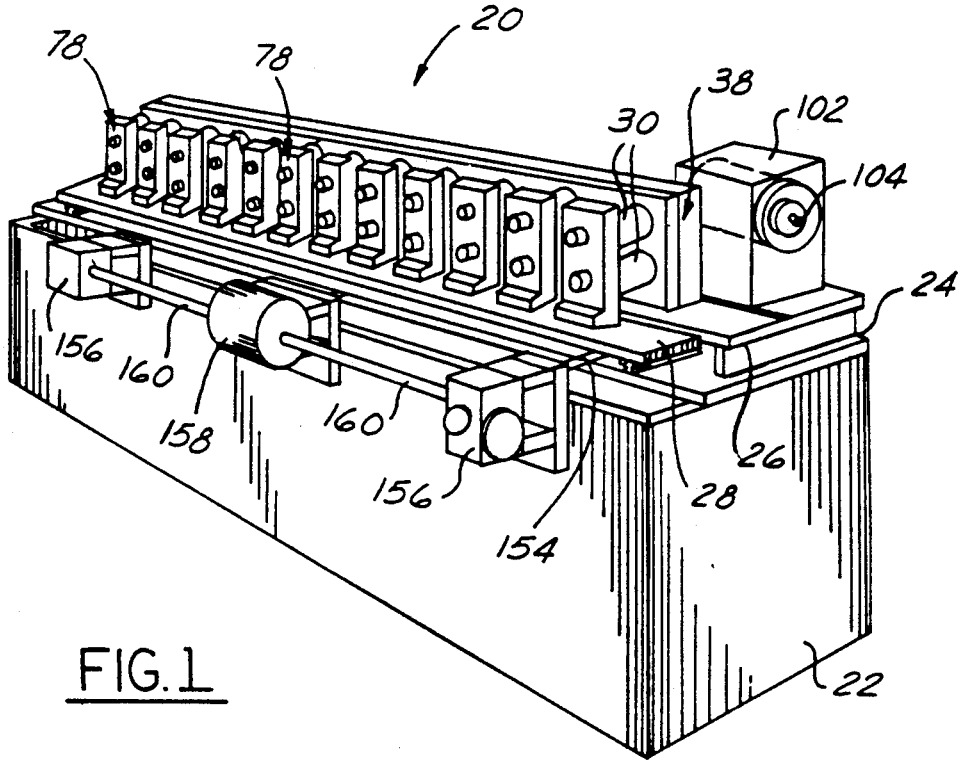
FIG. 1 is a perspective view of a construction embodying the present invention.

It is to be understood that the present invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DETAILED DESCRIPTION OF THE PREFERRED EMBODIMENTS

Referring now to FIGS. 1-4 there is shown a roll forming machine, generally designated by the numeral 20, embodying the construction of the present invention. The roll forming machine has a machine base 22 to which is fixedly mounted a mounting plate 24. To the mounting plate 24 is secured a fixed base plate 26 and a movable base plate 28. A unique feature of the present invention is the provision of adjustable or split roller shaft means, generally designated by the numeral 30.

Each pass at the metal sheet passing through the roll forming machine requires a pair of roller shaft means consisting of an upper roller shaft means 32 and a lower roller shaft means 34. The upper roller shaft means 32 consists of an upper shaft 36 journalled for rotation, in a manner to be described, in the upright spindle mounting plate or main block 38, and an upper spacer or sleeve 40, which is slidably fitted over a reduced diameter or sleeve receiving portion 42 of the upper shaft 36. The upper, roller receiving, shaft 36 comprises the reduced diameter portion 42, the lock nut accepting portion 44 and the full diameter portion 46. Likewise, lower, roller receiving shaft 48 consists of a reduced diameter portion 50, a lock nut accepting portion 52 and a full diameter portion 54.

Upper sleeve 40, having a journal portion 41, a flange portion 43, and a roller receiving portion 45 is slidably fitted over the reduced diameter portion 42 of upper shaft 36, and is provided with a first key way 56 and a first key 58 such that rollers 60 and spacers 62 may be fixedly retained on the roller receiving portion 45 of the upper sleeve 40 by means of the upper sleeve lock nut 64. The upper sleeve 40 is keyed to the reduced diameter portion 42 of the upper shaft 36 by means of the axially extending key way (not shown) and the second key 68.

A similar arrangement is used on the lower sleeve 70. Lower sleeve 70 has journal portion 71, flange portion 75 and roller receiving portion 77. A third key way 72 is provided in the inboard portion of the lower sleeve 70, in which a third key 74 is mounted. This provides for mounting of the rollers 60 and spacers 62 on the roller receiving portion 77 of the lower sleeve 70. They are held in place between the flange portion 75 and the lower sleeve lock nut 54.

The lower shaft 48 will rotatably drive the lower sleeve 70 by virtue of a fourth key 76 being mounted near the end of the reduced diameter portion 50 of the lower shaft 48. A second elongated axially extending key way (not shown) engages the fourth key 76.

The outboard ends of the upper roller shaft 36 and lower roller shaft 48 are journalled for rotation in the main block 38 by suitable bearings 80. The upper sleeve 40 is journalled for rotation in upright stand 78 by suitable bearings 80. The upright stand 78 is mounted by fastener 82 and fifth key 84 cooperating with base plate key way 86 to the movable base plate 28. A fastener 82 also passes through openings 88 in the movable base plate.

The upper adjustable roller shaft means 32 are adapted for vertical adjustments for regulating the vertical spacing between the upper roller shaft means 32 and the lower roller shaft means 34. For this purpose, adjustably positioned within corresponding apertures or slots 90 within the upright stands 78 and the main block 38 are a plurality of yokes 92 within which are mounted the upper set of bearings 80. Corresponding adjusting screws 73 are threaded downwardly through the respective stands 78 and main block 38 in supporting engagement with the corresponding yoke 92 for individual adjustment thereof within the slots 90, thereby adjusting the spacing between the upper roller shaft means 32 and the lower roller shaft means 34.

The power train used to power the upper adjustable roller shaft means 32 and the lower adjustable roller shaft means 34 can be any conventional power train of the type well known in the roller forming art. In the preferred embodiment, a power train such as that used in the aforementioned U.S. Pat. No. 4,831,857 is preferred, but without the clutch means, since they are not needed in a non-rafting type roller forming machine. It is well within the scope of the present invention to use such clutch means however, if they are desired.

Figure 8:
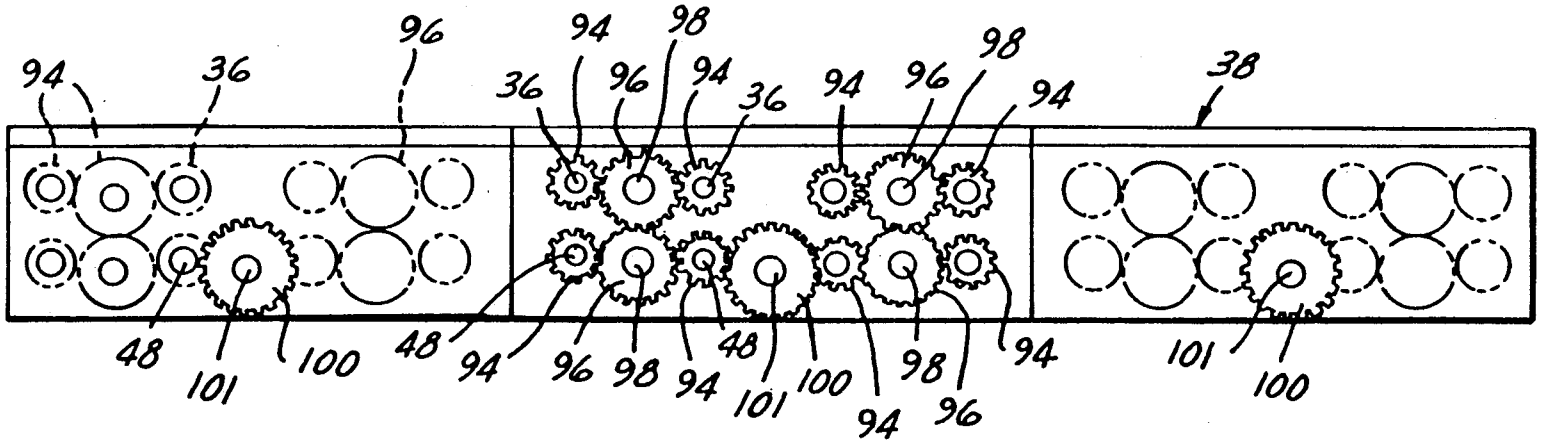
FIG. 8 is a sectional view, taken in the direction of the arrows, along the section line 8—8 of FIG. 2.

Referring now to FIG. 8, the present power gear train for each of three sets of spindles includes a spindle drive gear 94 secured upon the outboard end of the corresponding upper and lower shafts 36 and 48. The corresponding spindle drive gears 94 are in mesh with laterally adjacent, vertically aligned, and meshed pairs of idler gears 96 located on the stud shaft 98 which are mounted upon the main block 38 in the manner shown in FIG. 8.

Figure 5:
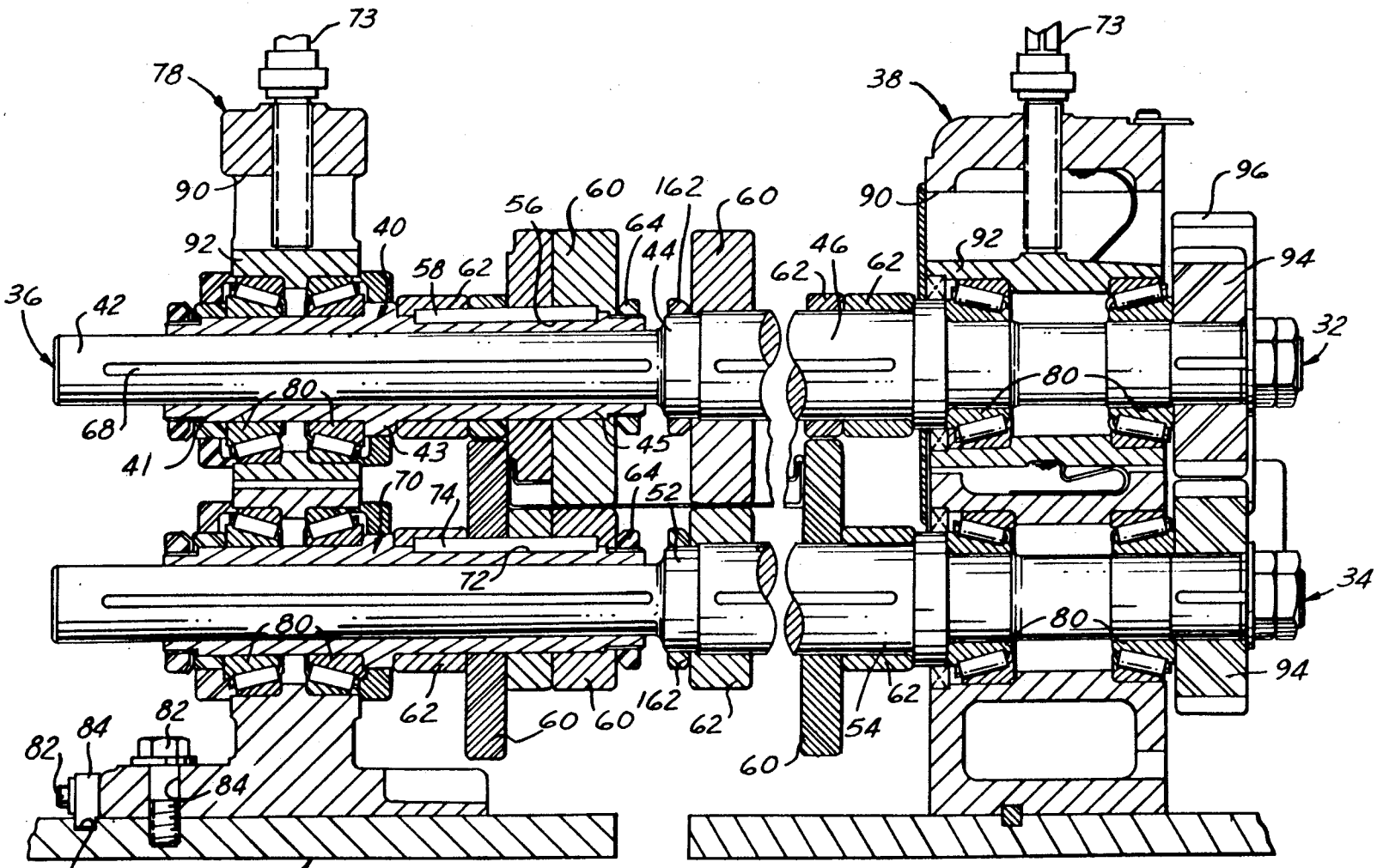
FIG. 5 is a sectional view, taken in the direction of the arrows, along the section line 5—5 of FIG. 3.

Each set of spindles as hereinafter defined includes, in the illustrated embodiment, four laterally spaced stands 78, and four pairs of upper and lower roller shaft means 32 and 34, as shown in FIG. 5. For each gear train centrally thereof, there is provided a drive gear 100 which is in mesh with adjacent lower spindle drive gear 94. The drive gears 100 are movably mounted and keyed on stud shafts 101, and supported and journalled upon main block 38. Idler gears 96, mounted on shafts 98, transfer power to the remaining spindle drive gears 94.

Figure 2:
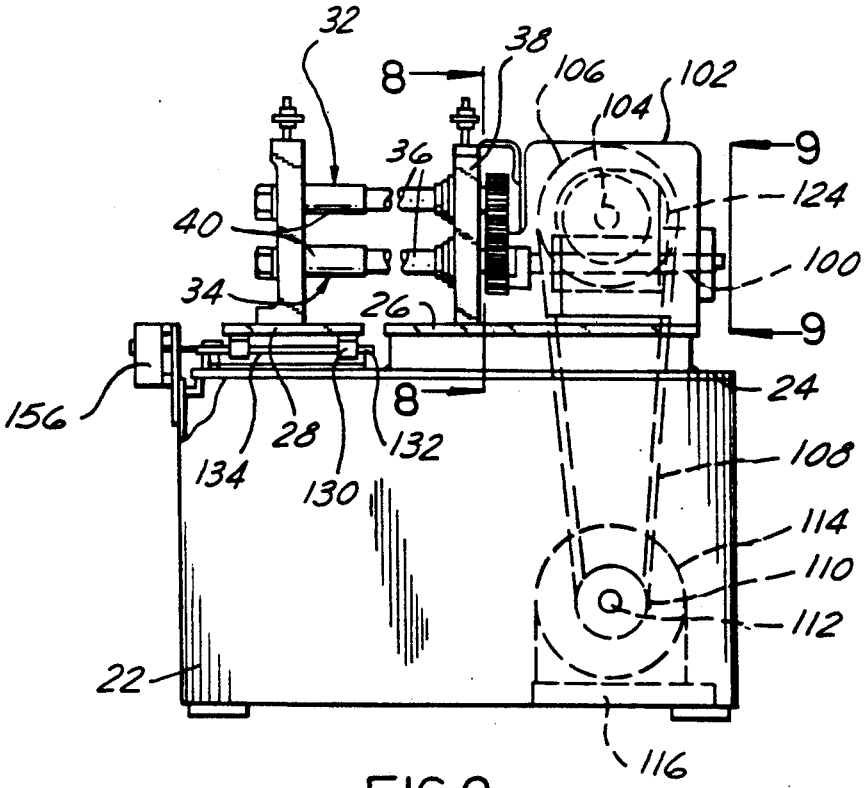
FIG. 2 is an end view of the construction shown in FIG. 1.
Figure 3:
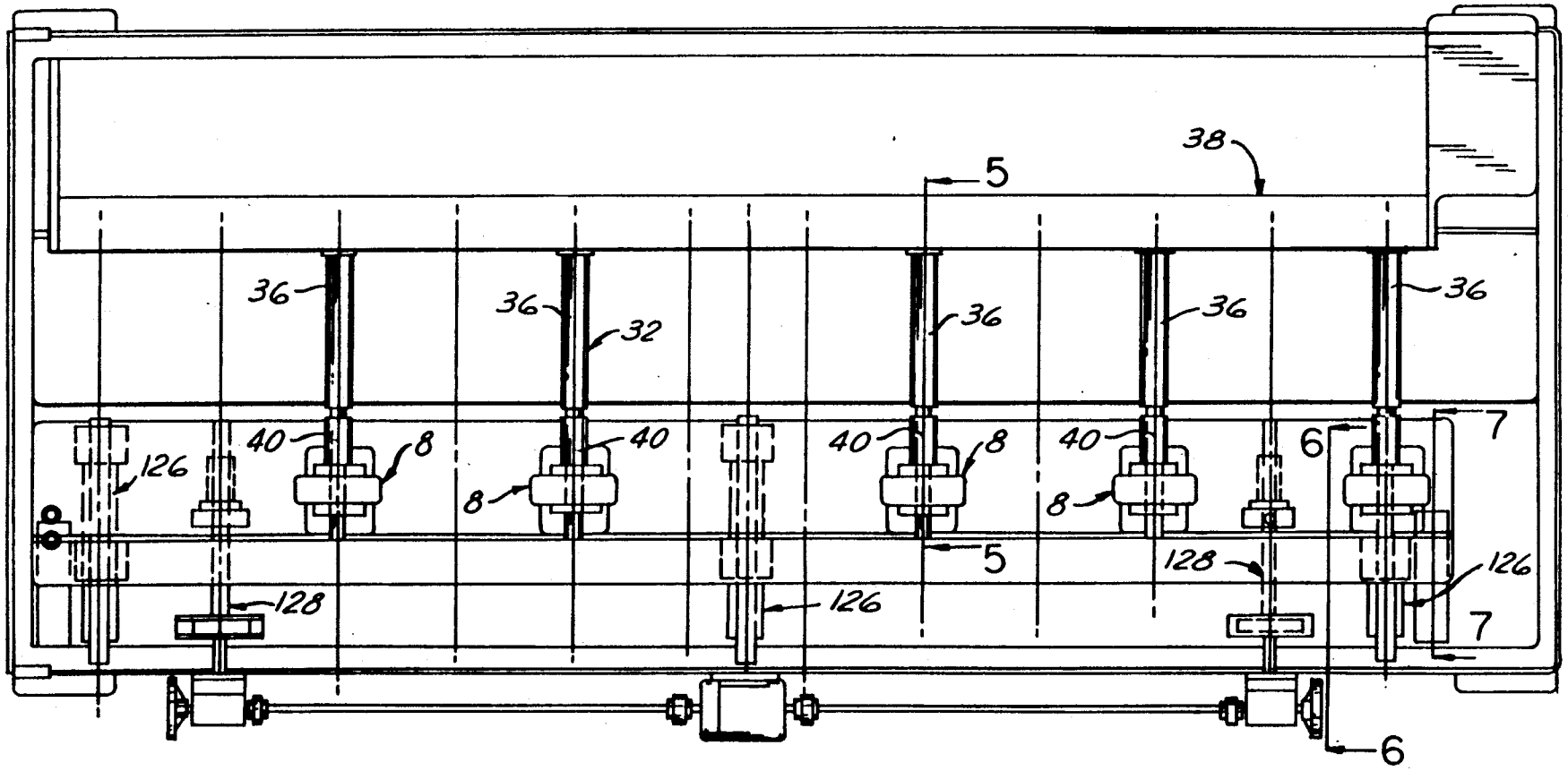
FIG. 3 is a plan view of the construction shown in FIG. 1.
Figure 4:
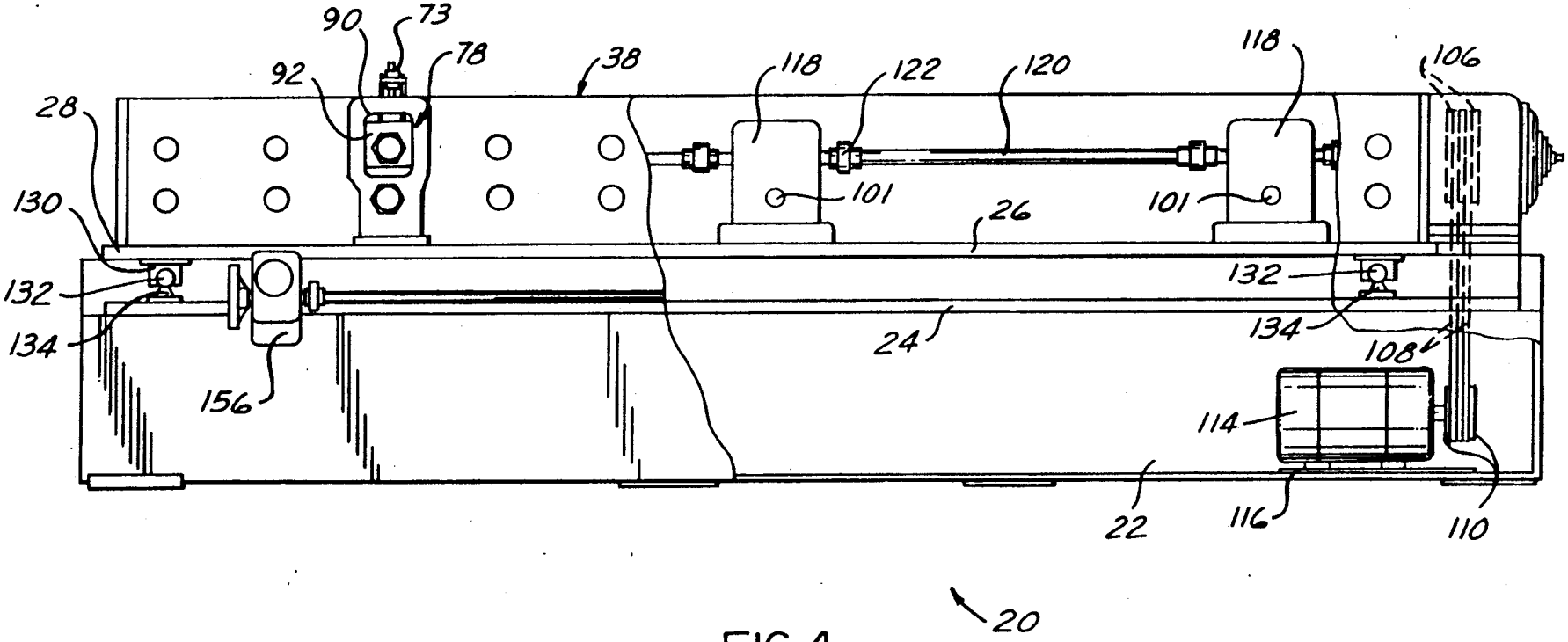
FIG. 4 is a front elevational view, partially broken away, of the construction shown in FIG. 3.
Figure 9:
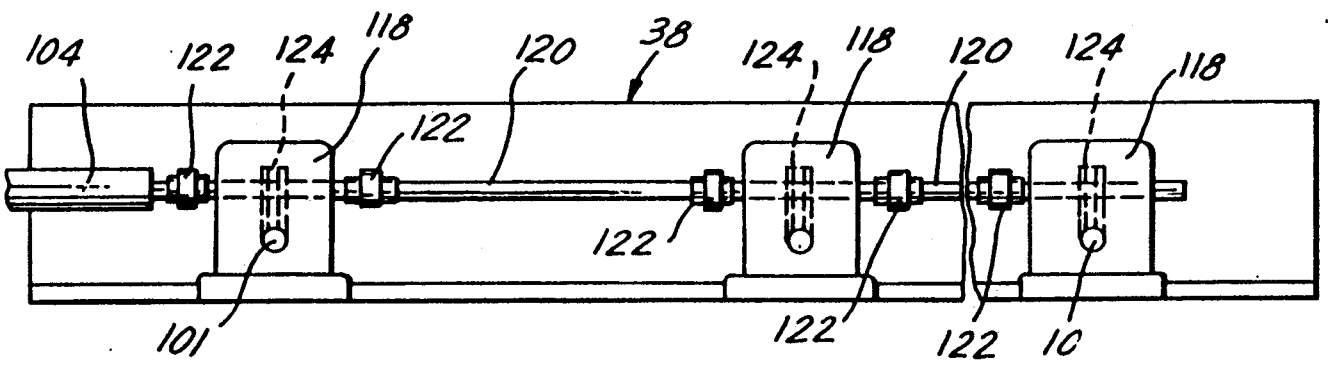
FIG. 9 is a sectional view, taken in the direction of the arrows, along the section line 8—8 of FIG. 2.

As shown in FIG. 2, overlying machine base 22 is the mounting plate 24 to which is affixed the fixed base plate 26 such as by welds or other fastening means. To the fixed base plate 26 is positioned and retained the present power drive transmission 102 anchored thereto. The power transmission housing includes an elongated drive shaft 104, as also shown in FIG. 9, which mounts a pair of pulleys 106. The pulleys 106 are connected by belts 108 to corresponding motor pulleys 110 located upon the drive shaft 112 of motor 114, sometimes referred to as a motor drive or motor drive means. Motor support 116 (FIG. 2) is mounted upon the machine base 22, and is suitably anchored thereto. This provides for the transmission of power drive to the transmission drive shaft 104. A series of longitudinally-spaced gear reduction boxes, sometimes referred to as worm gear reducers 118, or the equivalent, are mounted upon the machine base 22, and in the illustrated embodiment, upon the fixed base plate 26. The corresponding drive shaft 89 extends to adjacent worm gear reduction box 118, and to additional worm gear reduction boxes 118 using a series of shaft extensions or connectors 105 and couplings 107.

In the illustrated embodiment each of the respective gear reduction boxes 110 is adapted for providing rotative power to one of the corresponding three sets of gear trains (FIG. 8) and specifically the centrally arranged drive gear 100. In the illustrated embodiment, a suitable worm gear 124 transmits power from the rotation drive shaft 104 and extensions 120 to the drive shafts 101. In this way, rotation of each upper shaft 36 and lower shaft 48 is achieved, which will then drive corresponding upper sleeve 40 and lower sleeve 70. This provides for driving each set of upper and lower roller shaft means 32 and 34.

Adjustment of the upper and lower roller shaft means 32 and 34 is accomplished by lateral movement of the movable base plate 28 toward and away, or reciprocally, with respect to the fixed base plate 26. Referring to FIGS. 3, 5, 6 and 7, it can be seen that movable base plate 28 is connected to mounting plate 24 in the preferred embodiment of the invention at five different places. More or fewer mounting places, or points of connection, may be used depending upon the type of duty and the nature of the bending application to which the construction of the present invention is to be put.

Three of the points of connection are sliding connections 126 and two of the connections are power connections 128.

Figure 7:
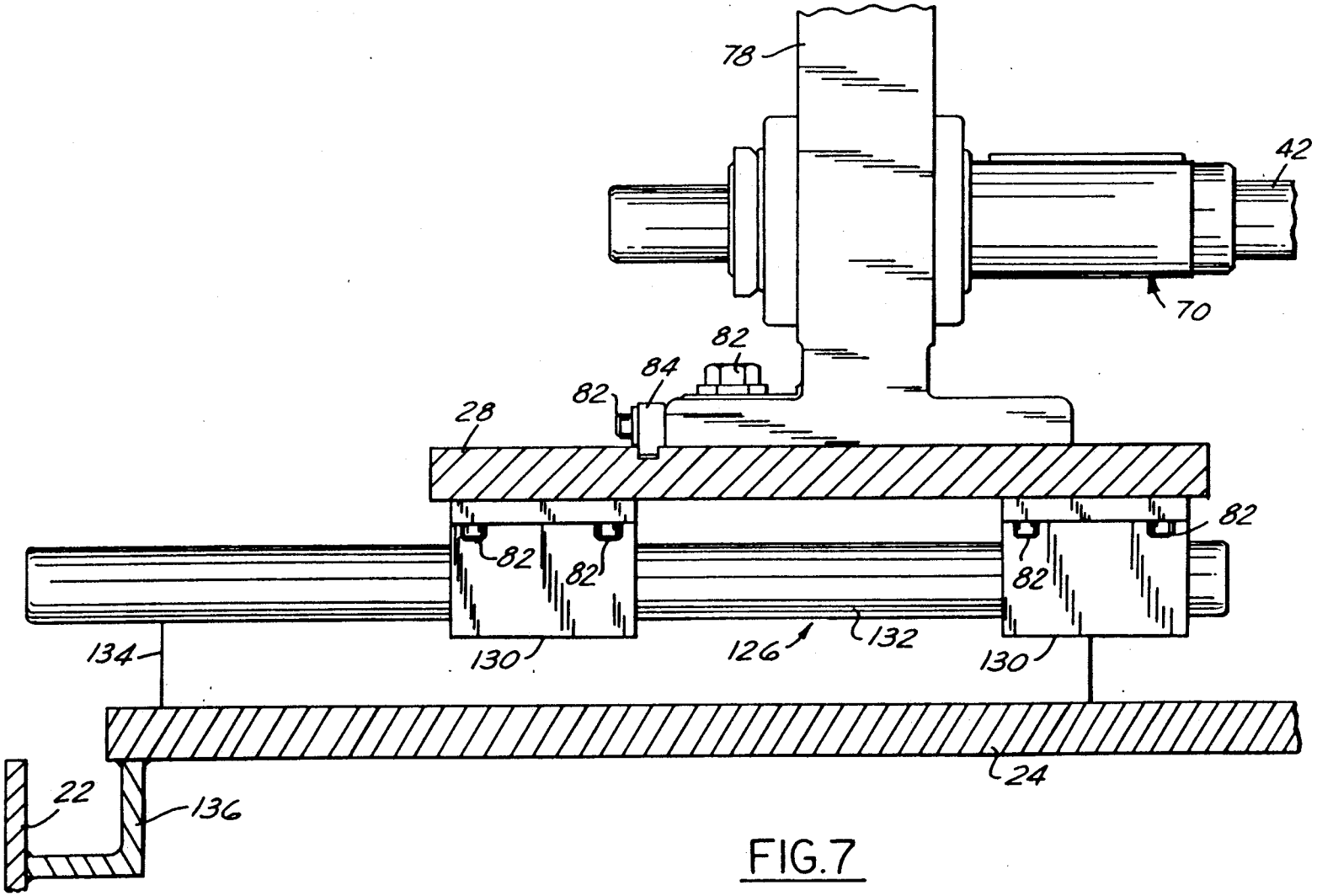
FIG. 7 is a sectional view, taken in the direction of the arrows, along the section line 7—7 of FIG. 3.

Referring to FIG. 7, each of the sliding connections 126 involves the fastening of a ball bushing 130 to the underside of the movable base plate 28 by suitable fasteners 82. The ball bushings 130 partially encircle a shaft 132 which is supported by shaft support 134. The laterally extending shaft support 134 is in turn fastened to the mounting plate 24 by suitable fastening means. It can be seen that the ball bushings 130, and thus the movable mounting plate 28, will easily slide over the shaft 132 providing for movement of the upright stands 78. Angle bracket 136 assists in fastening mounting plate 24 to machine base 22.

Figure 6:
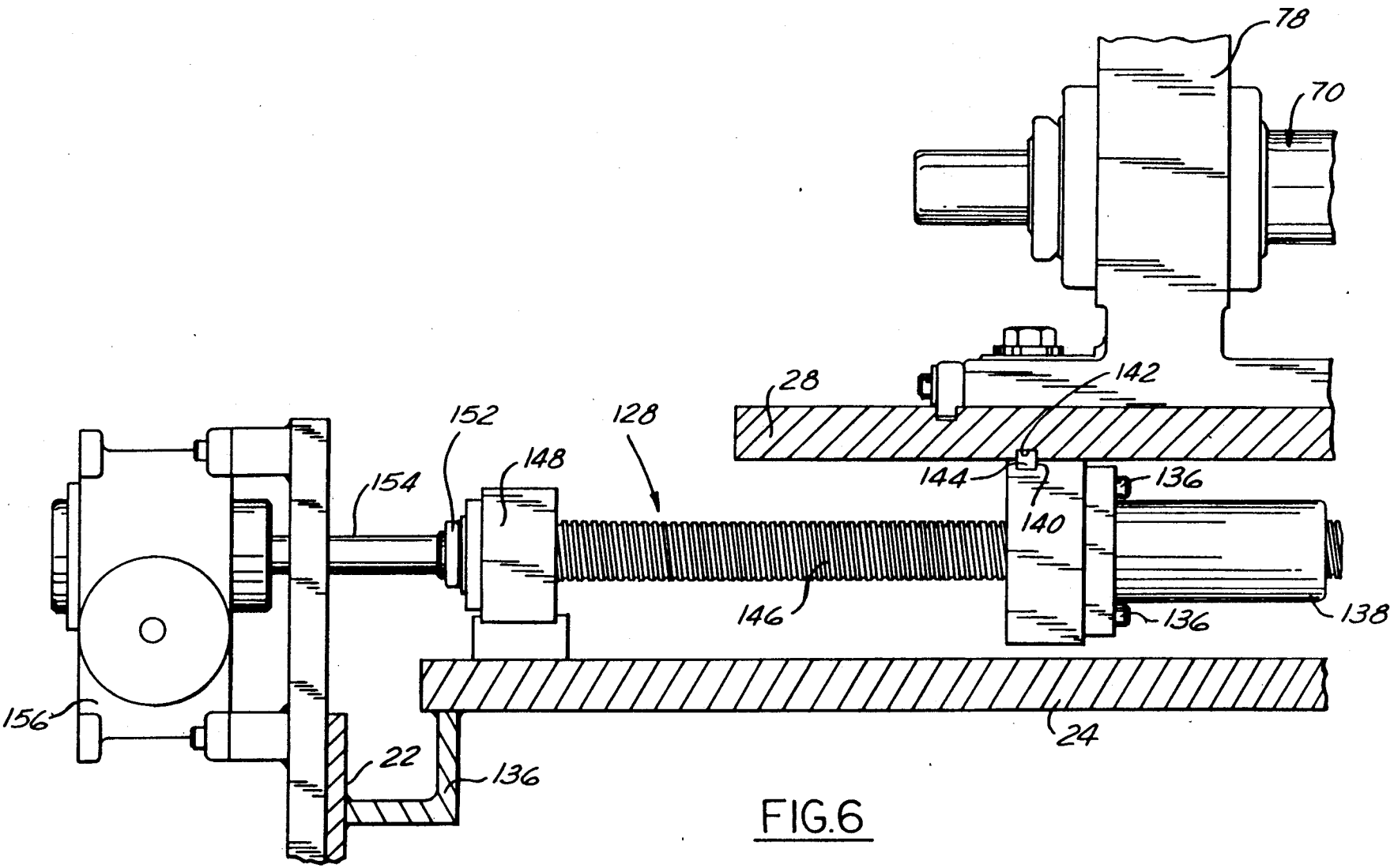
FIG. 6 is a sectional view, taken in the direction of the arrows, along the section line 6—6 of FIG. 3.

Referring to FIG. 6, in order to provide movement to the movable mounting plate 28, a plurality of powered connections 128 are provided. Each power connection 128 includes a preload ball nut 138 mounted to the underside of the movable base plate 28 by bolts 136. The ball nut 138 has a slot 140 therein which mates with a corresponding key slot 142 provided in the underside of the movable base plate 28. A ball nut key 144 thus keys and locates ball nut 138 to movable mounting plate 24. The ball nut 134 may have a flange and wiper kit installed, if desired.

The preload ball nut 138 completely encircles ball shaft 146 which is supported for rotation by journal 148 connected to mounting plate 24 by suitable means. Attached to the end of ball shaft 146 by lock nut 152 is drive shaft or output shaft 154. Output shaft 154 is rotated by base drive means or cone drive 156. Cone drives 156 are mounted opposite the ball shafts 126 and are connected to cone drive motor means or motor 158 by cone drive shafts 160 and coupling means or chain couplings 162. Operation of the cone drive motor 160 operates the cone drives 156 thus turning the drive shafts 154. This in turn rotates the ball shafts 146, which causes the movement of the preload ball nut 138 to move laterally or reciprocally over the ball shaft 146, and thus move the movable mounting plate 28 laterally with respect to the main block 38, thus causing the rotatable sleeves 40 and 70 to reciprocally slide over the upper and lower shafts 36 and 48, respectively widening or reducing the width of the upper and lower shaft means 32 and 34.

It can be seen that if a roll formed article of substantially uniform cross-section for example is to be made in many different widths, the present invention becomes particularly advantageous because it is only necessary to move the movable base plate to produce the cross-section in a new width. Such a changeover takes a matter of minutes instead of as in the prior art, a matter of hours.

Even though the present construction is particularly advantageous for producing articles of similar transverse cross-section in different widths, it also provides a roll forming machine which is particularly easy to convert to a new roll forming process by virtue of the mounting of the upright stands 78 by the special or fifth key 84 to the movable base plate. To change over to a new roll forming construction, the fastener 82 holding the special key 84 to each of the upright stands 78 is removed, followed by removing the fastener 82 from the movable base plate 24. By lateral or sideways movement of the stands 78, the upper and lower sleeves 40 and 70 will separate from the upper and lower shafts 36 and 48. By simple removal of the lock nuts 64 the sleeve mounted rollers 60 and spacers 62 can easily be changed as needed to a new configuration. If necessary, by simple removal of the lock nuts 162 from the lock nut receiving portions 44 of the upper shaft and lower shaft 36 and 48, the rollers can easily be removed from the shafts and replaced with a new configuration, whereupon the sleeves can be reinserted over the shafts, the stands 78 can be quickly and easily relocated and fastened to the movable base plate 28, and the roll forming machine 20 is then set up to produce a new roller formed part.

Thus, by providing heretofore unknown adjustable width upper and lower roller shaft means in a roll forming machine, an improved roll forming machine which can easily be changed from production of one part to another by removal of the upright stands from a removable base plate, and which can be changed to produce a part of a similar transverse cross-section to a part being produced, but of a different width in a manner of minutes instead of hours, has been provided.

I claim:

1. An improved roll forming machine including, in combination:

a machine base;

a mounting plate mounted to said machine base;

a fixed base plate mounted to said mounting plate;

a movable base plate mounted to said mounting plate;

a drive means mounted to said machine base;

a transmission means mounted to said fixed base plate and connected to said drive means for operation;

a first plurality of vertically aligned, longitudinally-spaced, pairs of complimentary roller receiving shafts arranged in longitudinal pairs and mounted to said fixed base, driven by said transmission means, each pair of complimentary roller receiving shafts defining an upper and lower roller receiving shaft;

a second, equal, plurality of vertically aligned, longitudinally-spaced, pairs of complimentary roller receiving sleeves axially aligned with their respective roller receiving shafts arranged in longitudinal pairs, each roller receiving sleeve being axially movable with respect to and driven by said respective shaft and mounted to said movable plate for lateral movement on and along the axis of said shaft, each pair of complimentary roller receiving sleeves defining an upper and lower roller receiving sleeve;

base drive means to drive said movable base, and thereby said sleeves, toward and away from said fixed base, whereby the width of the stock which can be passed through said roll forming machine is varied;

each pair of complimentary roller receiving shafts being supportively received and journaled for rotation in a main block mounted upon said fixed base plate;

each pair of complimentary roller receiving sleeves being mounted in one of a plurality of longitudinal-spaced, upright, stands arranged in a row spaced from and parallel to said main block on said movable base plate, each of said roller receiving sleeves having a flange;

each of said upper and lower roller receiving sleeves receiving rollers between said flange and a lock nut threadably attached to an end of a roller receiving portion;

a key way provided in said roller receiving portion of said lower roller receiving sleeve to fix and attach rollers to said sleeves;

said upper roller receiving shaft and said lower roller receiving shaft each include a reduced diameter portion, a lock nut receiving portion, and a roller receiving portion, said reduced diameter portion located at an end of each roller receiving shaft with the reduced diameter portion of each roller receiving shaft interfitted with a respective roller receiving sleeve;

said lock nut receiving portion of said roller receiving shaft having a lock nut threadably attached thereto for retaining rollers on said roller receiving portion of said shaft such that the roller can be changed to arrive at different roller configurations;

said roller receiving portion of each of said pairs of roller receiving shafts having a key way and a key provided therein to accept and attach rollers to said roller receiving shaft, and said interfitting of each roller receiving shaft with a respective roller receiving sleeve being such that the lock nut on the roller receiving shaft faces the lock nut on the roller receiving sleeve.

2. The roll forming machine defined in claim 1, wherein said main block is keyed to said fixed base plate.

3. The roll forming machine defined in claim 1, wherein each of said upright stands is keyed to said movable base plate.

4. The roll forming machine defined in claim 1, wherein said transmission means are connected to said roller receiving shafts by a worm wheel and worm gear assembly.

5. The roller forming machine defined in claim 1, wherein said transmission means includes a gear train, including a plurality of gears interconnecting the complimentary roller receiving shafts for rotation in unison, and including a drive gear connected to said transmission means.

6. The roll forming machine defined in claim 1, wherein the mounting of the upper of each pair of said complimentary upper roll receiving shafts includes opposed apertured yokes adjustably and guidably mounted within and upon said main block, journaling and supporting the outboard ends of said upper roller receiving shafts, and an adjustable screw means threaded into said main block supportively mounting said yokes respectively for individually adjusting said yokes for modifying the center distance between the upper and lower roller receiving shaft.

7. The roll forming machine defined in claim 1, wherein the mounting of the upper of each of said roller receiving sleeves includes opposed apertured yokes adjustably and guidably mounted within and upon each upright stand, journaling and supporting the outboard ends of said roller receiving sleeves, and an adjustable screw means threaded upon each stand supportively mounting said yokes respectively for individually adjusting said yokes for modifying the center distance between each pair of sleeves.

8. The roll forming machine defined in claim 1, wherein each of said upper and lower roller receiving sleeves includes a journal portion and a sleeve receiving portion separated by a flange.

9. The roll forming machine defined in claim 1, wherein said reduced diameter portion of each roller receiving shaft is of a smaller diameter than said roller receiving portion, and is keyed to its respective roller receiving sleeve to drive the same.

* * * * *